US011851862B2

(12) United States Patent
Wölfler et al.

(10) Patent No.: US 11,851,862 B2
(45) Date of Patent: Dec. 26, 2023

(54) SINK WITH BASIN AND SEPARATE MOVABLE INSERT PLATE WHICH SEALS A DRAIN IN THE BASIN

(71) Applicant: BSH Hausgeräte GmbH, Munich (DE)

(72) Inventors: Andreas Wölfler, Saalfelden (AT); Benjamin Reu, Prien am Chiemsee (DE); Jörg Sukale, Altenmarkt a.d. Alz (DE)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 17/777,069

(22) PCT Filed: Nov. 11, 2020

(86) PCT No.: PCT/EP2020/081742

§ 371 (c)(1),
(2) Date: May 16, 2022

(87) PCT Pub. No.: WO2021/104875

PCT Pub. Date: Jun. 3, 2021

(65) Prior Publication Data

US 2022/0403635 A1 Dec. 22, 2022

(30) Foreign Application Priority Data

Nov. 29, 2019 (DE) ..... 102019218649.1

(51) Int. Cl.
*E03C 1/186* (2019.01)

(52) U.S. Cl.
CPC ..... *E03C 1/186* (2013.01)

(58) Field of Classification Search
CPC ..... A47J 47/20; E03C 1/186; E03C 1/181; E03C 1/262; A47L 19/02; A47L 17/02
See application file for complete search history.

(56) References Cited

U.S. PATENT DOCUMENTS

| | | | | |
|---|---|---|---|---|
| 2,457,038 | A * | 12/1948 | Garonis | A47J 47/20 4/387 |
| 3,882,553 | A | 5/1975 | Poiencot | |
| 8,635,718 | B1 * | 1/2014 | Giagni, Sr. | E03C 1/186 4/514 |
| 2005/0067747 | A1 | 3/2005 | Erickson | |

FOREIGN PATENT DOCUMENTS

| | | | |
|---|---|---|---|
| CN | 106579805 | A | 4/2017 |
| CN | 108316413 | A | 7/2018 |
| DE | 3621151 | A1 | 1/1988 |

OTHER PUBLICATIONS

Machine Translation of CN106579805. Espacenet. (Year: 2023).*
National Search Report DE 10 2019 218 649.1 dated Aug. 21, 2020.
International Search Report PCT/EP2020/081742 dated Feb. 2, 2021.

* cited by examiner

*Primary Examiner* — Erin Deery
(74) *Attorney, Agent, or Firm* — Michael E. Tschupp; Andre Pallapies; Brandon G. Braun

(57) ABSTRACT

A sink includes a basin including a base wall having a drain opening for media to run out of the basin, and lateral walls adjoining the base wall. The basin includes a receiving area which is delimited by the base wall and the lateral walls. An insert plate separate from the basin is inserted into the receiving area and movable by a lifting apparatus relative to the basin. A closure apparatus is arranged on the insert plate and is configured to prevent media in the basin from running to the drain opening.

11 Claims, 3 Drawing Sheets

SINK WITH BASIN AND SEPARATE MOVABLE INSERT PLATE WHICH SEALS A DRAIN IN THE BASIN

CROSS-REFERENCES TO RELATED APPLICATIONS

This application is the U.S. National Stage of International Application No. PCT/EP2020/081742, filed Nov. 11, 2020, which designated the United States and has been published as International Publication No. WO 2021/104875 A1 and which claims the priority of German Patent Application, Serial No. 10 2019 218 649.1, filed Nov. 29, 2019, pursuant to 35 U.S.C. 119(a)-(d).

The contents of International Application No. PCT/EP2020/081742 and German Patent Application, Serial No. 10 2019 218 649.1 are incorporated herein by reference in their entireties as if fully set forth herein.

BACKGROUND OF THE INVENTION

One aspect of the invention relates to a sink with a basin. The basin has a base wall and lateral walls adjoining it. The basin has a receiving area delimited by the walls. Furthermore the sink has an insert plate separate from the basin that is inserted into the receiving area.

These types of sink are known. Thus for example US 2005/0067747 A1 discloses a sink, which has a basin. Embodied in one piece on the base of the basin is a stanchion that extends upward. A plate can be placed on this stanchion. This forms a cutting board on which objects such as foodstuffs can be cut. Such an embodiment is disadvantageous to the extent that the integrated stanchion is always present and thus a basic design of the basin is complex in its shape and also the receiving area around it is embodied in a restricted manner. Furthermore the plate able to be placed on the stanchion is always only arranged at one height level. It can only be put on or removed by a user.

Furthermore a sink is disclosed in DE 362 1151 A1. Different inserts that can be inserted into the receiving area are provided separately from the basin. The inserts can be plates or further basin-like containers. These can be placed on the upper edge of the basin. The usability of a sink is also greatly reduced by this and the inserts must be fitted or removed by a user and are always only able to be positioned at one individual location.

BRIEF SUMMARY OF THE INVENTION

The object of the present invention is to create a sink with a basin and a separate insert plate, in which the insert plate is used in more multifunctional ways.

One aspect of the invention relates to a sink with a basin. The basin has a base wall and lateral walls adjoining it. Furthermore the basin has a receiving area, which is delimited by the base wall and the lateral walls. The receiving area is open at the top. The sink has an insert unit separate from the basin, especially an insert plate, especially a contiguous and hole-free insert plate. This is able to be inserted into the receiving area or is inserted into it. Furthermore the sink has a lifting apparatus with which the insert plate is able to be moved in the height direction of the sink relative to the basin. This is made possible by a physical lifting apparatus of the sink. Thus a sink is now provided in which basically the option is created for arranging the insert unit at different height positions. Furthermore, this is also made possible by a lifting apparatus and does not have to done manually by users themselves. Basically it is made possible for a continuous height adjustment of the insert plate to be made possible by the lifting apparatus. This thus enables countless height levels of the insert plate to be moved to and set.

Furthermore the base wall has a drain opening for draining media out of the basin. A closure apparatus is arranged on the insert plate. The media in the basin can be prevented from running to the drain opening by the closure apparatus. This type of embodiment thus makes it possible for the sink itself no longer to need a closure that closes off the drain opening directly, in particular for example by use of a known strainer. This strainer, which is inserted into the drain opening and can be adjusted in the height direction, is thus no longer needed. Such strainers have long been known. They must however be actuated by means of a relatively complex guided mechanism. For example a lever is arranged on one side edge of the sink for this purpose. Likewise it is also possible however for such a strainer to be pushed downward or pulled upward by direct contact. However, in doing this, the user must take hold of this strainer directly. In particular when media are present in the basin this strainer is usually dirty. A user must then take hold of this at times dirty strainer. This is disadvantageous for reasons of hygiene. With the proposed sink it is now possible for such a closure apparatus no longer to have to be inserted directly into the drain opening. Furthermore it is arranged directly on an additional component that is present in any case, namely the insert plate. Depending on the height position of the insert plate, it is thus easily made possible, using the closure facility, to avoid the media running out of the receiving area of the basin to the drain opening. On the other hand, if the insert plate is lifted upward from such a closure position or lowered position for the closure apparatus, the media in the receiving area is released to run to the drain opening.

In particular the closure apparatus is thus integrated into the insert plate. Thus, from the height position of the insert plate, a closed position or an open position of the closure apparatus can also be set automatically. This makes possible an especially advantageous concept for enabling or inhibiting a draining away of media to the drain opening.

In one advantageous embodiment there is provision for the closure apparatus to have a seal. This seal is especially arranged on an underside of the insert plate. It is thus in an advantageous position. This is because on the one hand the seal can rest directly against corresponding inner sides of walls of the basin in order easily to release or to seal off the drain opening in the base wall. Since the insert plate also has a greater weight, especially a far greater weight, compared to a conventional strainer, a weight force is also formed by the insert plate, which presses the seal on the underside firmly against an inner side of a wall of the basin. An especially advantageous sealing concept is achieved thereby when media are to be prevented from running out of the receiving area to the drain opening.

Furthermore the seal is also protected from other influences by such a position. In particular when objects are introduced into the receiving area they are in contact with the upper side of the insert plate in any event, but not with the underside however. This avoids damage to the seal.

In an advantageous embodiment there is provision for the seal, in a lowered position of the insert plate and thus in a sealing position, to be seated locally around the drain opening on an inner side of the base wall of the basin. There is thus in particular provision for the seal not to intrude into the drain opening itself. An improved sealing concept is achieved by it being seated around the drain opening on the inner side of the base wall. Undesired leaks or the like can thereby be avoided in an enhanced way.

In a further advantageous embodiment there is provision for the seal, in a lowered position of the insert plate and thus in a sealing position of the insert plate, to be seated on a sloping wall of the basin. The sloping wall is embodied between a vertical lateral wall and the base wall. A correspondingly advantageous sealing concept is also achieved by this. With this embodiment in particular there is also provision for the seal to be arranged practically directly next to or directly adjoining an outer edge of the insert plate on the underside of the insert plate. Thus, in this lowered position of the insert plate, the complete area below the insert plate is effectively sealed off. Penetration of media below the insert plate is then avoided in this sealing position.

Preferably there is provision for the sink to have a separate strainer. There can be provision for the strainer to be arranged directly in the drain opening. The strainer is arranged in the drain opening such that it can be adjusted in the height direction of the sink. There can be provision for the closure apparatus to have an actuation element, which, when a lowered position of the insert plate in the sink is set, is in contact with the strainer in the opened position. When the lowered position is reached the strainer is pushed automatically by the actuation element into the closed position. This too is an alternate embodiment. Thus the strainer does not have to be put into the corresponding positions by users themselves and in particular no longer has to be taken hold of directly. Creating a complex actuation mechanism for this strainer is also avoided by this embodiment.

There can be provision for the strainer to be able to be pushed upward automatically from the closed position into the open position by a pusher element, in particular a spring, when the insert plate is moved upward from the lowered position. The open state of the strainer is thereby set automatically when the insert plate is moved upward. Thus the media is always guaranteed to run away via the drain opening when the insert plate is no longer positioned in the lowered position and this type of strainer is still present.

In particular there is provision for the sink to have a seal that is arranged at an edge of the insert plate. This edge is the side edge or the circumferential edge of the insert plate. There is provision for this seal to protrude beyond the edge so that the seal, at least in a lowered position of the insert plate, rests to form a seal against the inner sides of the vertical lateral walls of the basin. An axial sealing concept and thus a sealing concept in the direction of the vertical axis of the sink is not formed, but instead a sealing concept at right angles thereto is realized.

There can also be provision for the closure apparatus to have an inflatable elastic membrane. This membrane is in particular arranged on the underside of the insert plate. In the inflated state of the membrane media are prevented from running out of the receiving area to the drain opening. In particular when the insert plate is arranged in the lowered position. There can be provision for the sink to have a pump. The membrane can be inflated by this pump. In particular when the closure position is no longer needed and the insert plate is moved upward, there can be an automatic exhausting of air from this membrane. The membrane can be an inflatable tube for example. The membrane can be attached to an underside of the insert plate and/or to an outer edge of the insert plate.

In an advantageous embodiment there is provision for an upper side of the insert plate to have a surface that amounts to at least 80 percent, especially at least 90 percent, especially at least 95 percent of the surface of the receiving area in a horizontal plane. The surface of the upper side is however less than 99 percent of this surface of the receiving area. Such dimensioning enables the insert plate to be embodied over practically the entire surface of the full width of the receiving area between the lateral walls and thus fill this receiving area almost completely, viewed in the horizontal plane. On the other hand however a small circumferential gap, especially between 3 mm and 15 mm, especially between 3 mm and 10 mm, is made possible, so that on the one hand a relative movement of the insert plate during a positioning or a change of position can take place unhindered. In particular direct contact and where necessary a side edge of the insert plate sliding along of the inner sides of the lateral wall can be avoided. On the one hand damage to the lateral walls is thus avoided and on the other hand damage to the insert plate and also to the lifting mechanism can also be avoided. Last but not least, what is also advantageously achieved by this embodiment is that, through this gap between the edge of the insert plate and the inner sides of the lateral walls, liquid that is present on the upper side of the insert plate can run away into the receiving area without any problems.

Preferably the basin, especially on the base wall, has an outflow. Medium that is arranged in the basin and collects there can drain out via the outflow without any problems.

In particular the basin is embodied in one piece with the base wall and the lateral walls, in particular the basin is embodied from metal.

The base wall can be flat or slightly inclined or slightly curved. In particular there is provision for that point on the base wall, at which the outlet for an outflow of the sink is embodied, to be set furthest down as regards the height position.

There can be provision for the upper side of the plate to be embodied completely flat. It can however also have a slight curve. It is also possible for the upper side of the insert plate to be structured at least in some areas. A certain roughness can be achieved thereby. This enables undesired sliding off of objects placed thereon to be avoided in an improved manner. This is advantageous for example when a change in position of the insert plate occurs and there are still objects arranged on the upper side of the insert plate. Likewise it is possible for the upper side to have certain positioning areas. These can be indentations. For example such indentations can be embodied relatively small however. This is advantageous for example for being able to position vessels such as a glass or the like more securely. This is in particular advantageous when a change of position is a tipping and/or a rotation. An undesired slipping off of such vessels is then avoided. Furthermore what is also achieved by such predetermined positioning areas is that when vessels are placed on the upper side of the insert plate and are to be filled from the water faucet for example, during a rotational movement, the water flowing out of the water faucet runs safely into the vessels and does not strike the insert plate by running past the edges of the vessels.

The lifting apparatus can have a lifting unit and a motor. The lifting unit can be moved at least in the height direction with the motor.

The positions and orientations given for the correct use and the correct arrangement of the sink are specified by the terms “up”, “down”, “forward”, “backward”, “horizontal”, “vertical”, “depth direction”, “width direction”, “height direction”.

Further features of the invention emerge from the claims, the figures and the description of the figures. The features and combinations of features given in the description, as well as the features and combinations of features given below in the description of the figures and/or shown in the figures alone are not only able to be used in the combination specified in each case but also in other combinations or on their own, without departing from the scope of the invention. Thus embodiments of the invention that are not shown and explained explicitly in the figures, but which stem from and are able to be created from separated combinations of features from the explained embodiments are also to be seen as included and disclosed. Embodiments and combinations of features that thus do not have all features of an originally formulated independent claim are also to be seen as disclosed.

BRIEF DESCRIPTION OF THE DRAWINGS

Exemplary embodiments of the invention are explained below in greater detail with the aid of schematic drawings. In the figures.

DETAILED DESCRIPTION OF EXEMPLARY EMBODIMENTS OF THE PRESENT INVENTION

Figure 1:
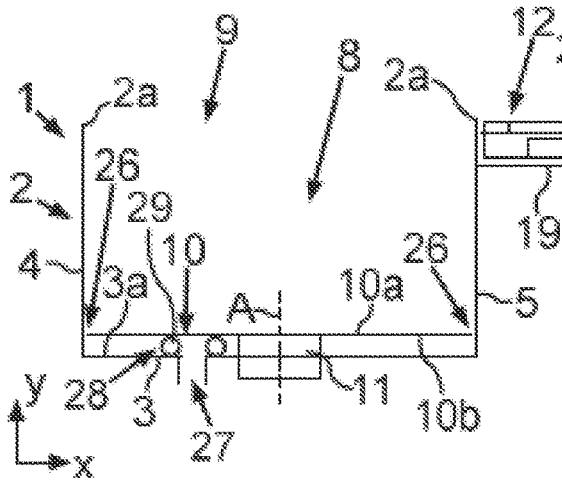
FIG. 1 shows a schematic sectional view through an exemplary embodiment of an inventive sink with an insert plate in a first position.

Elements that are the same or that have the same function are labeled with the same reference characters in the figures.

Shown in FIG. 1 in a schematic vertical sectional diagram (x-y plane with height direction y and width direction x) is a sink 1. The sink 1 has a basin 2. The basin 2 has a base wall 3 and also lateral walls 4, 5, 6 (FIG. 3) and 7 (FIG. 3) adjoining said wall and extending upward. The basin 2 is in particular in one piece. It is preferably embodied from metal. The basin 2 has a receiving area 8. The receiving area 8 is delimited by the said walls 3 to 7. Thus the basin 2 has an upper loading opening 9. Furthermore the sink 1 has an insert unit. The insert unit is in particular an insert plate 10. The insert plate 10 is especially embodied in one piece. The insert plate 10 is a separate component of the sink 1 from the basin 2. The sink furthermore has a lifting apparatus 11. The insert plate is arranged on the lifting apparatus 11. In particular it is arranged on the lifting apparatus 11 so that it can be released therefrom in a non-destructive manner. The lifting apparatus 11 enables the insert plate 10 to be moved relative to the basin 2. In this connection there can be a movement in the height direction (y direction) of the sink 1. In addition to or instead of this there can be a rotation about a vertical axis A of the lifting apparatus 11. In addition to or instead of this there can be a tilting of the insert plate 10. This means that the insert plate 10 can be set with its plane at an angle to a horizontal plane. It can thus be positioned inclined or at a slant. In FIG. 1 the insert plate 10 is shown in a typical position in the receiving area 8. In particular this is a position in which it is moved downward. The insert plate 10 is arranged in this regard directly adjacent to the base wall 3.

Figure 3:
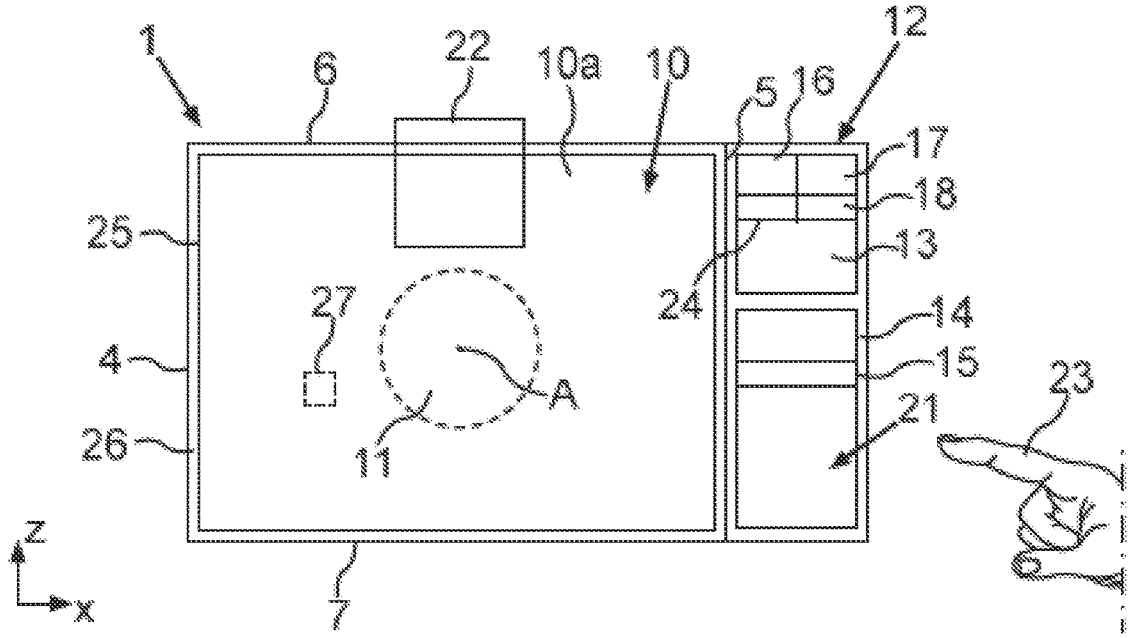
FIG. 3 shows an overhead view of an exemplary embodiment of a sink.

Preferably the sink 1 has an interaction unit 12. The interaction unit 12 can have a display unit 13 (FIG. 3). The interaction unit 12 can have an operating apparatus 14. The operating apparatus 14 can have one or more operating elements. The operating elements can be pushbuttons or switches or lever elements or rotary dials. The operating apparatus 14 can however, in addition to or as an alternative to said elements, have a touch-sensitive operating panel 15. In an advantageous embodiment there can be provision for the interaction unit 12 to have at least one optical detection unit 16. The optical detection unit 16 can be a camera for example. The camera can be sensitive in the range of the spectrum visible to humans. The interaction unit 12, in addition or as an alternative to this, can also have an acoustic unit 17. This acoustic unit 17 can be embodied for receiving and/or for outputting voice signals. Furthermore the interaction unit 12 can have an identification unit 18. The identification unit 18 is embodied for recognition or for identification of a user of the sink 1. The identification unit 18 can also be embodied by the optical detection unit 16 for example. In addition to or instead of this however, the identification unit 18 can also have the acoustic unit 17 for example. This enables the user to be identified by evaluation of a user's voice signal, In addition to or instead of this the identification unit 18 can be embodied as a unit for acquiring and evaluating a biometric feature of a user. This can be a fingerprint sensor or a sensor for recognizing an iris pattern.

Figure 2:
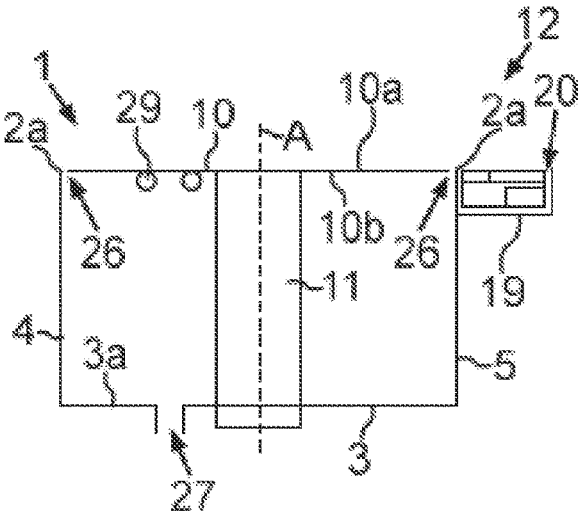
FIG. 2 shows the diagram of the sink in accordance with FIG. 2 with the insert plate in a second position different from FIG. 1.

As can be seen from FIGS. 1 to 3, the interaction unit 12 can be embodied to the side of and immediately adjacent to the basin 2. For example a receiving housing 19 open toward the top can be provided here. The receiving housing 19 can be embodied separately from the basin 2. It can also, however, be formed with the basin 2 such that it cannot be released in a non-destructive manner. In particular the receiving housing 19 can also be embodied in one piece with the basin 2. The lateral wall directly adjoining the receiving housing 19, here in the example the lateral wall 5, also forms a delimiting wall for the receiving volume 20 of the receiving housing 19.

Thus the receiving volume 20 is separated from the receiving area 8 for the basin.

Shown in FIG. 2 is the diagram in accordance with FIG. 1, but with the insert plate 10 shown in a different position to that in FIG. 1. In FIG. 2 the insert plate 10 is oriented horizontally, but moved upward however. In particular, in the normal mode, this position represents the maximum possible height location. In particular in this position an upper side 10*a* of the insert plate 10 is flush with an upper edge 2*a* of the basin 2. In particular, in this position, the insert plate 10 forms a cover or a lid for the receiving area 8. This upper edge 2*a* can however also be an upper side of a mounting frame or a decorative frame, which is an element of the sink 1 for example. With the mounting frame the sink 1, in particular the basin 2, can be mounted in a cutout of a worktop. The basin 2 can be covered from above by the decorative frame. A gap between the basin 2 and a delimiting wall in the worktop, which delimits the cutout, can thus be covered from above. Such a decorative frame in particular represents an upper visual element of the arrangement.

In particular the sink 1 also has a control unit 21 (FIG. 3). The control unit 21 enables the lifting apparatus 11 to be operated. In particular the interaction unit 12 can also be operated by the control unit 21.

The sink 1 can, as can be seen in the simplified overhead view in FIG. 3, preferably also have a water faucet 22. The water faucet 22 represents a functional unit of the sink 1. Likewise the interaction unit 12, especially the operating apparatus 14, can be seen as a functional unit of the sink 1. A further functional unit of the sink 1 can be the insert plate 10. A further functional unit of the sink 1 can be the lifting apparatus 11.

The lifting apparatus 11 preferably has a lifting unit and a motor. These enable it to change its length or its height in the direction of the vertical axis A. Furthermore, in addition to or instead of this, it can be rotated about the vertical axis. This also enables a rotational movement about this vertical axis A to be made possible as a position or a change of position as a position of the insert plate 10. Last but not least the lifting apparatus 11 can also be set so that the insert plate 10 can be set at an angle or inclined in relation to the horizontal plane.

The interaction unit 12 allows an operating state of the sink 1 to be seen and/or a change in the operating state of the sink 1 to be seen and/or an operating action of the user who is operating the sink 1, especially at least one functional element of the sink 1, to be seen. Depending on the recognition by the interaction unit 12, the lifting apparatus 11 is able to be operated to automatically change the position of the insert plate 10. Furthermore FIG. 3 also shows a schematic depiction of a finger 23 of a user. The interaction unit 12 is preferably embodied to detect a gesture of the user, especially of the finger 23. In particular the gesture is a contactless gesture. In addition to or instead of this however there can also be a direct operation of the operating apparatus 14 with the finger 23. There is provision for an operating state and/or a change of operating state to be able to be detected by the camera 16 and/or the acoustic unit 17 and/or the operating apparatus 14. An operating state can for example be a position of the operating apparatus 14 and/or a change in the operating state can be a change in the position of the operating apparatus 14.

A change in position of the insert plate 10 can be dependent on the type and/or strength and/or duration of an operating state of at least one functional unit of the sink 1 and/or a change in position can be dependent on the type and/or strength and/or duration of a change in operating state of at least one such functional unit of the sink 1.

The interaction unit 12 has a normal mode. In this mode the actual operation of the sink 1 is also detected. Furthermore the interaction unit 12 has a definition mode that differs from the normal mode. This can be set by a user for example. In this definition mode it is made possible for at least one user to define or predetermine at least one reference position of the insert plate 10. In particular such a reference position can be linked in this definition mode to a specific operating state of at least one functional unit of the sink 1 and/or to a defined change in operating state of at least one functional unit of the sink 1. At least one such reference position can be stored as a user profile in a memory unit 24 of the interaction unit 12.

In an advantageous embodiment there is provision for the surface shown in FIG. 3 (depth direction z and width direction x) of the upper side 10*a* to amount to at least 80 percent, especially at least 90 percent, especially at least 95 percent of the surface of the receiving area 8, which is viewed in a horizontal plane (the plane of the figure in FIG. 3). In particular this surface of the upper side 10*a* is however less than 99 percent of this surface of the receiving area 8 in the said horizontal plane. What is achieved by this is that a circumferential edge 25 of the insert plate 10 is at a distance from the lateral walls 4, 5, 6 and 7. In particular a circumferential gap 26 between the insert plate 10 and the lateral walls 4 to 7 is formed by this. The gap 26 can amount to between 3 mm and 15 mm. Preferably this gap 26, at least in the horizontal position of the insert plate 10, is so small that objects such as cutlery or the like cannot slip through it. A finger 23 getting caught in the gap can then also be avoided in this horizontal position of the insert plate 10.

Furthermore it can also be seen from FIGS. 1 to 3 that the basin 2 has a drain opening 27 or an outflow. In the exemplary embodiment this drain opening 27 is embodied in the base wall 3.

Arranged on an underside 10*b* of the insert plate 10 is a closure apparatus 28, as shown in FIG. 1. This closure apparatus 28 is embodied to enable or prevent media running out of the receiving area 8 to the drain opening 27. In particular the closure apparatus 28 is attached directly to the underside 10*b*. The closure apparatus 28 in particular has a seal 29. As can also be seen in conjunction with FIG. 1, the seal 29 is embodied so that it seals locally around the drain opening 27. In FIG. 1 the lowered state or the lowered position of the insert plate 10 is shown in this context. This is also the sealing position. In this sealing position the seal 29 lies directly from above on an inner side 34*a* of the base wall 3. The seal 27 is seated on this inner side 3*a*, outside the drain opening 27 and surrounding the circumference of the drain opening 27. In this sealing position in particular the insert plate 10 has moved so far downward that the seal 29 is also at least slightly compressed. This further improves the sealing behavior. In particular the seal 29 is thus clamped between the insert plate 10 and the upper side 3*a*.

In FIG. 2, compared to the lowered position in accordance with FIG. 1, in the position with the plate moved upward, in particular the position with the plate moved fully upward, this sealing is released and media is able to run into the receiving area 8 to the drain opening 27.

Figure 4:
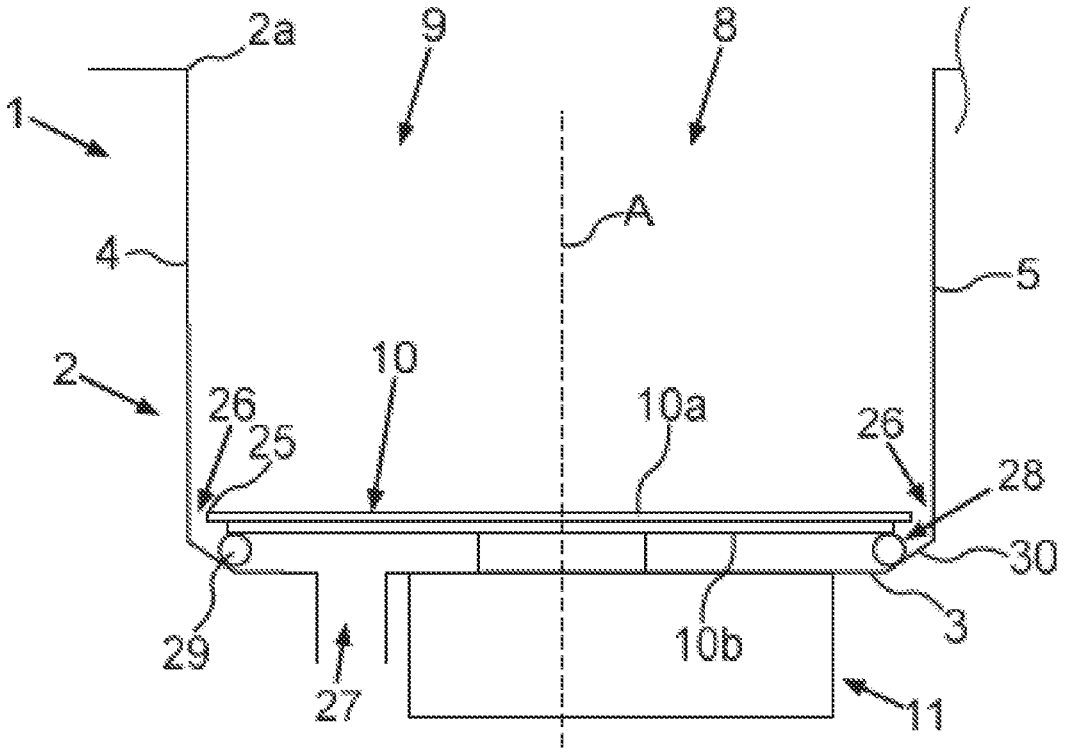
FIG. 4 shows a further schematic sectional view through an exemplary embodiment of an inventive sink in which a drain opening in the basin of the sink is closed off by a closure apparatus.

Shown in FIG. 4 in an alternate embodiment is a sectional diagram corresponding to that shown in FIG. 1. In this embodiment a sloping wall 30 is embodied between the base wall 2 and the lateral walls 4, 5, 6 and 7. This is inclined at a corresponding angle to the base wall 3 and also at an angle to the vertical lateral walls 4 to 7. This produces a certain funnel-like structure of the lower area of the basin 2. In this embodiment there is provision for the seal 29 to be arranged on the underside 10*b* of the insert plate 10 so that, in this lowered position, it sits directly against the inner side of this sloping wall 30. Thus in particular the whole area below the insert plate 10 is sealed in this lowered position and not just a local area around the drain opening 27.

Figure 5:
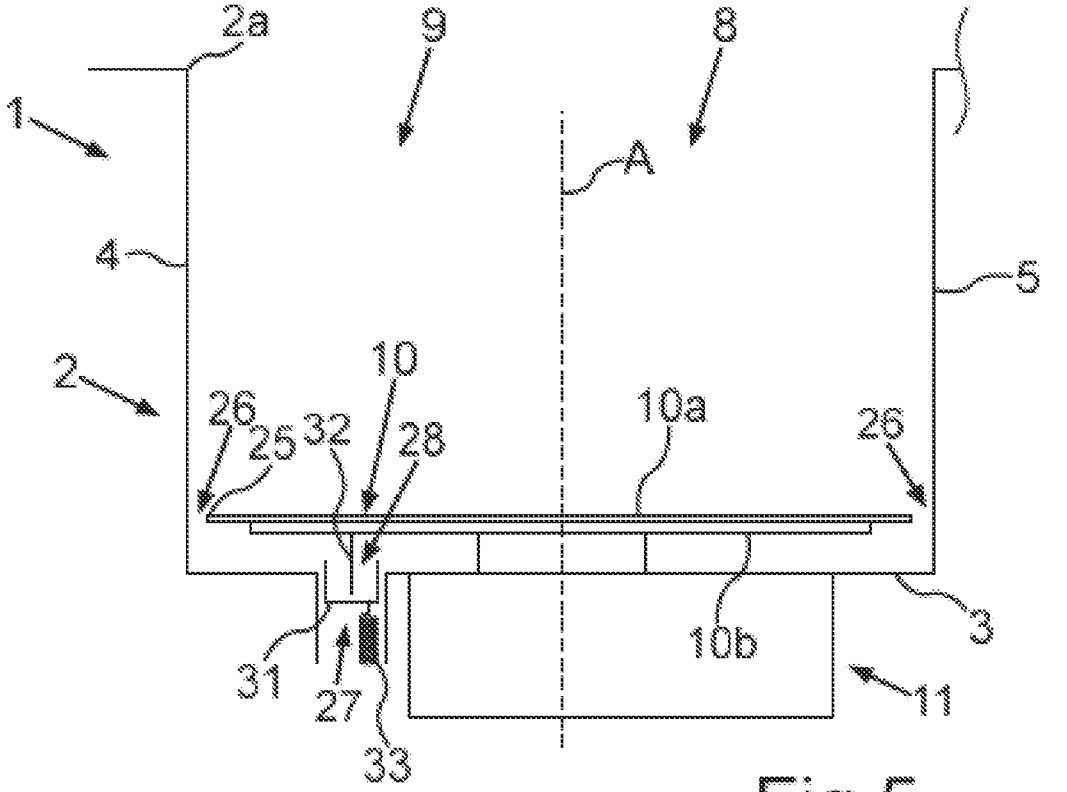
FIG. 5 shows a further schematic sectional view through a further exemplary embodiment of an inventive sink in which a drain opening in the basin of the sink is closed off by a closure apparatus.

Shown in FIG. 5, in a simplified vertical sectional diagram, is a further exemplary embodiment of the basin 1. Just like in FIG. 4, for the sake of clarity, in FIG. 5 too the components 12 to 24 are not shown in the diagram. In this exemplary embodiment a seal 29 is not necessarily present. It can be present however. In particular in the exemplary embodiment in FIG. 5 a separate strainer 31 is shown. The strainer 31 is inserted in the drain opening 27 itself. It is positioned for height adjustment in the direction of an axis in parallel to axis A. In the lowered position of the insert plate 10, as is shown schematically in FIG. 5, an actuation element 32 of the closure apparatus 28 is in mechanical contact with the strainer 31. This actuation element 32 is arranged on the underside 10*b* and is below it. In particular this actuation element can be a plunger for example. With this actuation element 32 the strainer 31 is pushed downward when the insert plate 10 is moved from above into this lowered position. The strainer 31 is then automatically pushed downward thereby and thus brought into the closure position in the drain opening 27. There can preferably be provision for a resetting element 33 to be provided. This can be a spring for example. Through the resetting element 33 the strainer 31 is automatically brought upward again from the closed position into the open position when the insert plate 10 is moved upward again from the lowered position shown in FIG. 5.

Figure 6:
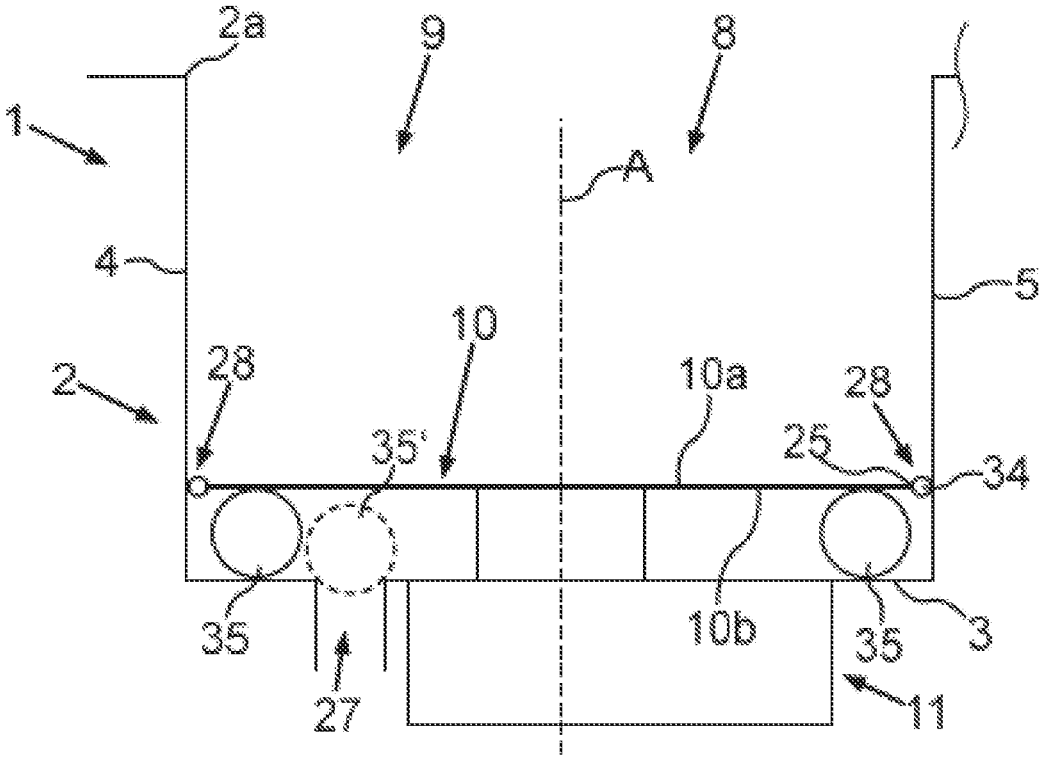
FIG. 6 shows a further schematic sectional view through an exemplary embodiment of an inventive sink in which a drain opening in the basin of the sink is closed off by the closure apparatus.

Shown in FIG. 6 is a further exemplary embodiment of a basin 1 in a simplified vertical sectional diagram. In this exemplary embodiment there is provision for a seal 34 to be arranged on a side edge or a narrow outer edge of the insert plate 10. This seal 34 thus protrudes, viewed in a direction at right angles to axis A, laterally beyond this insert plate 10. In the lowered state or in the lowered position of the insert plate 10, as shown in FIG. 6, it rests against inner walls of the vertical lateral walls 4, 5, 6 and 7. Thus a corresponding seal to that area below the insert plate in the receiving area 8 is achieved. The drain opening 27 is thus also sealed.

In addition to or instead of the examples given above, there can be provision in a further exemplary embodiment for an inflatable membrane 35 to be arranged on the underside 10*b*. In the lowered position of the insert plate 10, which is also the sealing position, this preferably rests against an inner side 3*a* of the base wall 3, in particular outside the drain opening 27. This inflatable membrane 35 can be an inflatable circular tube for example. There can however also be provision for it to be an inflatable ball. In such an embodiment there can also be provision for an inflatable membrane 35' to be present which is formed by this spherical shape. In such an embodiment this inflatable membrane 35' can then be arranged directly above the drain opening 27 on the underside 10*b* of the insert plate 10. In the lowered position of the insert plate 10 this inflatable membrane, which basically and considered in general terms is also elastic, is pushed from above into the drain opening 27. A sealing closure of the drain opening 27 from above is also made possible in this way. This inflatable membrane 35' can be present in addition to or instead of the inflatable membrane 35.

A dismantling mode different from the normal mode of the lifting unit of the lifting apparatus 11 can also be set. In this mode the lifting unit is set beyond the maximum raised position of the lifting unit in its normal mode and thus also sets the corresponding position of the insert plate 10 to a position lying even higher in the height direction. In the maximum raised position in normal mode there is in particular provision for the upper side 10*a* of the insert plate to be flush with the upper side of the upper edge 2*a* of the basin 2 or with a decorative frame or an installation frame. In the dismantling position lying higher than this, the insert plate 10 is preferably positioned so that it is arranged with its underside 10*b* higher than this upper edge 2*a* by a vertical distance. In particular this vertical distance amounts to at least 2 cm, especially to 3 cm. This enables an edge 25 the insert plate 10 to be grasped with a hand and held securely to remove it from the lifting unit. The dismantling position is in particular a horizontal location of the insert plate 10. The underside 10*b* of the insert plate is thus positioned completely above the upper edge 2*a*.

The invention claimed is:

1. A sink, comprising:

a basin including a base wall having a drain opening for media to run out of the basin, and lateral walls adjoining the base wall, said basin including a receiving area delimited by the base wall and the lateral walls;

an insert plate separate from the basin and inserted into the receiving area;

a lifting apparatus configured to move the insert plate relative to the basin; and a closure apparatus arranged on the insert plate and configured to prevent media in the basin from running to the drain opening, and a separate strainer arranged in the drain opening and configured for adjustment in a height direction between an open position and a closed position, said closure apparatus including an actuation element which, when setting a lowered position of the insert plate in the basin, contacts the strainer in the open position, and which pushes the strainer into the closed position when the insert plate reaches the lowered position.

2. The sink of claim 1, wherein the closure apparatus includes a seal, which is arranged on an underside of the insert plate.

3. The sink of claim 2, wherein the seal is seated locally around the drain opening on an inner side of the base wall when the insert plate assumes the lowered position.

4. The sink of claim 2, wherein the basin includes a sloping wall, which is embodied between the lateral walls and the base wall, said seal being seated on an inner side of the sloping wall of the basin when the insert plate assumes a lowered position.

5. The sink of claim 1, further comprising a resetting unit operably connected to the strainer for pushing the strainer automatically from the closed position back into the open position when the insert plate is moved upward from the lowered position.

6. The sink of claim 5, wherein the resetting unit is a spring.

7. The sink of claim 1, wherein the insert plate includes an upper side which has a surface that amounts to at least 80% of a surface of the receiving area in a horizontal plane, but is less than 99% of the surface of the receiving area.

8. The sink of claim 1, wherein the insert plate includes an upper side which has a surface that amounts to at least 90% of a surface of the receiving area in a horizontal plane, but is less than 99% of the surface of the receiving area.

9. The sink of claim 1, wherein the insert plate includes an upper side which has a surface that amounts to at least 95% of a surface of the receiving area in a horizontal plane, but is less than 99% of the surface of the receiving area.

10. The sink of claim 1, further comprising a seal arranged on an edge of the insert plate and protruding laterally beyond the edge, so that the seal, at least in the lowered position of the insert plate, sealingly rests in the basin against inner sides of the lateral walls.

11. A sink, comprising:

a basin including a base wall having a drain opening for media to run out of the basin, and lateral walls adjoining the base wall, said basin including a receiving area delimited by the base wall and the lateral walls;

an insert plate separate from the basin and inserted into the receiving area;

a lifting apparatus configured to move the insert plate relative to the basin; and a closure apparatus arranged on the insert plate and configured to prevent media in the basin from running to the drain opening, and wherein the closure apparatus includes an inflatable elastic membrane, which is arranged on an underside of the insert plate and which prevents media in the basin from running to the drain opening, when the elastic membrane is inflated.

* * * * *